US008020603B2

(12) United States Patent
Bürgin

(10) Patent No.: US 8,020,603 B2
(45) Date of Patent: Sep. 20, 2011

(54) BLOCKING ELEMENT, PARTICULARLY FOR A GATE USED AS A CHECKPOINT

(75) Inventor: Thomas Bürgin, Lörrach (DE)

(73) Assignee: Magnetic Auto Control GmbH, Schopfheim (DE)

( * ) Notice: Subject to any disclaimer, the term of this patent is extended or adjusted under 35 U.S.C. 154(b) by 502 days.

(21) Appl. No.: 11/992,973

(22) PCT Filed: Sep. 27, 2006

(86) PCT No.: PCT/DE2006/001704

§ 371 (c)(1),
(2), (4) Date: May 9, 2008

(87) PCT Pub. No.: WO2007/036216

PCT Pub. Date: Apr. 5, 2007

(65) Prior Publication Data

US 2009/0107049 A1 Apr. 30, 2009

(30) Foreign Application Priority Data

Sep. 29, 2005 (DE) ..... 20 2005 015 373 U

(51) Int. Cl.
*E06B 3/94* (2006.01)

(52) U.S. Cl. ..... 160/134; 49/49; 49/41

(58) Field of Classification Search ..... 49/49, 41; 160/134

See application file for complete search history.

(56) References Cited

U.S. PATENT DOCUMENTS 823,350 A * 6/1906 Morrill ..... 49/41
1,613,364 A * 1/1927 Thompson ..... 296/97.8
3,169,329 A * 2/1965 Powers ..... 49/35
3,386,202 A * 6/1968 Crews et al. ..... 49/35
3,478,467 A * 11/1969 May ..... 49/35

(Continued)

FOREIGN PATENT DOCUMENTS

DE 1923801 11/1969

(Continued)

OTHER PUBLICATIONS www.automaticsystems.com Gunne BO Entrance Control AB for 720 Series Airort access control Internetaufiritt Bier FA Automatic Control Systems Inc., Lecherchiert A7 Feb. 2, 2006.

(Continued)

*Primary Examiner* — Jerry Redman
(74) *Attorney, Agent, or Firm* — Horst M. Kasper

(57) ABSTRACT

A blocking element for a gate used as a checkpoint includes a housing having a height, a support having a second height and arranged in the housing, a horizontally directed pivot axis furnished on the support, and a pair of blocking vanes each of which are in a form of a circle sector, wherein the pair of blocking vanes are mounted, by way of a tapering sector inner side of the blocking vanes and such that the blocking vanes can pivot about the horizontally directed pivot axis. A drive motor is connected to the blocking vanes on the pivot axis, wherein the drive motor in response to a signal, slides one of the blocking vanes into the other in a telescopic manner from a position which blocks a passage of the gate into a position, which opens the passage of the gate, and wherein the blocking vanes can be drawn apart from one another in order to again block the passage of the gate.

20 Claims, 7 Drawing Sheets

U.S. PATENT DOCUMENTS

Figure 1:
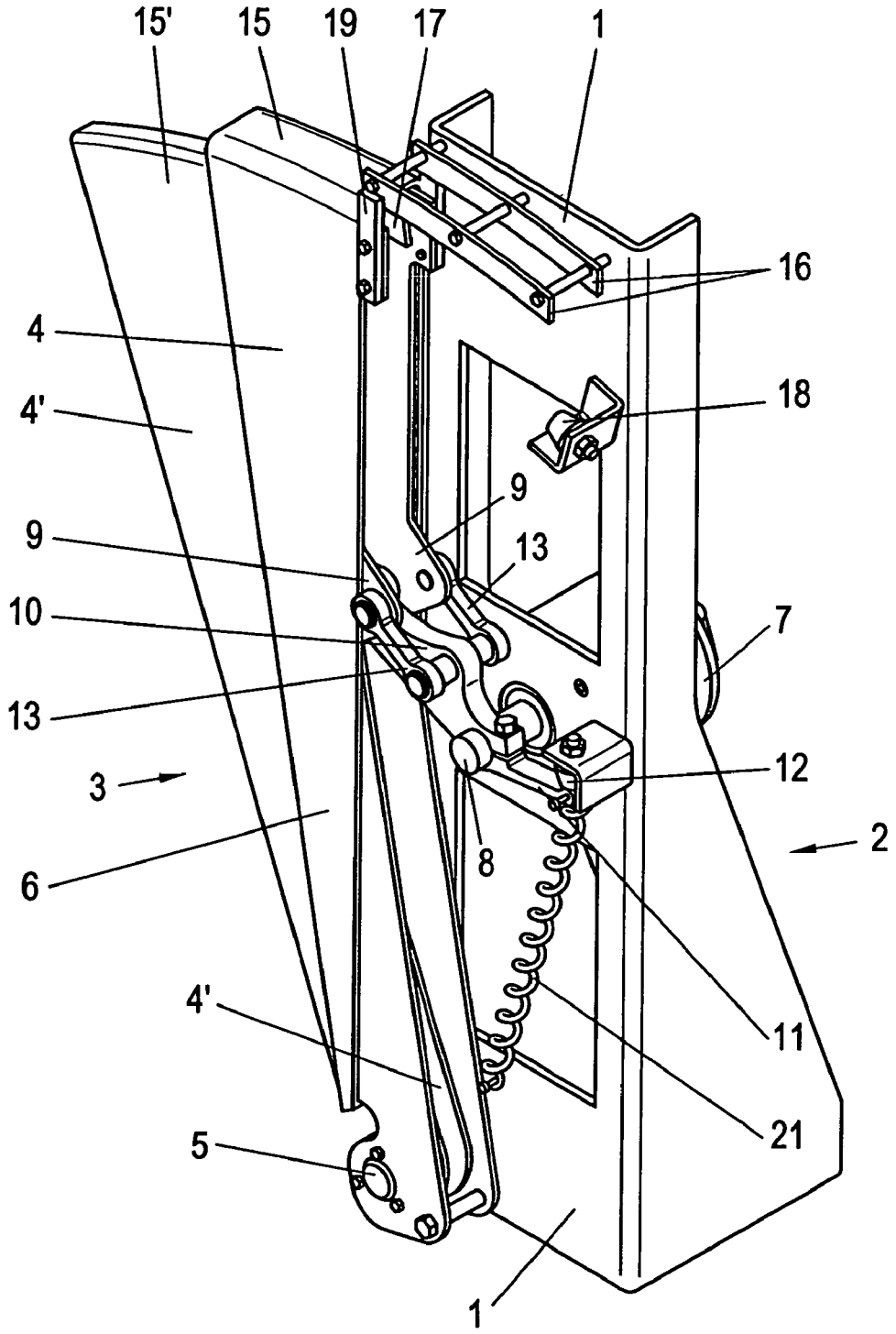

| | | | | | |
|---|---|---|---|---|---|
| 3,606,698 | A | * | 9/1971 | Toshio et al. | 49/35 |
| 3,633,311 | A | * | 1/1972 | Ulmann | 49/35 |
| 3,827,182 | A | * | 8/1974 | Van Helleputte | 49/40 |
| 4,104,827 | A | * | 8/1978 | Opron et al. | 49/385 |
| 5,794,680 | A | * | 8/1998 | Xue | 160/84.07 |
| 7,617,974 | B2 | * | 11/2009 | Vandyck et al. | 235/382 |

FOREIGN PATENT DOCUMENTS

| | | |
|---|---|---|
| DE | 1774195 | 9/1971 |
| DE | 2825787 | 12/1979 |
| DE | 4445689 | 6/1996 |
| FR | 2849519 | 7/2004 |
| FR | 2855208 | 11/2004 |
| FR | 2855209 | 11/2004 |
| FR | 2866918 | 9/2005 |
| GB | 1337087 | 11/1973 |

OTHER PUBLICATIONS

Internet URL:http://www.automatic.systems.com/upload/Images/PT_Hougangstation%20,Singapore.

* cited by examiner

BLOCKING ELEMENT, PARTICULARLY FOR A GATE USED AS A CHECKPOINT

(a) TITLE OF THE INVENTION

(b) CROSS-REFERENCE TO RELATED APPLICATIONS.

(not applicable)

(c) STATEMENT REGARDING FEDERALLY SPONSORED RESEARCH OR DEVELOPMENT.

(not applicable)

(d) THE NAMES OF THE PARTIES TO A JOINT RESEARCH AGREEMENT.

(not applicable)

(e) INCORPORATION-BY-REFERENCE OF MATERIAL SUBMITTED ON A COMPACT DISC.

(not applicable)

(f) BACKGROUND OF THE INVENTION.

(1) Field of the Invention.

The invention relates to a blocking element, particularly for a gate used as a checkpoint, which comprises two circle-sector-like blocking vanes which are mounted, by way of their narrow sector inner side and such that they can pivot about a horizontally directed pivot axis, on a support which is arranged in the housing and in response to a signal, in a manner driven by a drive motor, can slide one over the other or one into the other in a fan-like or telescopic manner from a position which blocks the passage, in order to open the passage, and can be drawn apart from one another in order to again block the passage.

(2) Description of Related Art including information disclosed under 37 CFR 1.97 and 1.98.

Known blocking elements for so-called turnstiles used as checkpoints, for example as disclosed by DE patent 28 25 787 or DE 44 45 698 C2, are blocking units which can be rotated about a rotary axis which is inclined downward through approximately 45° and preferably have three blocking arms which are inclined in relation to the rotary axis and of which in each case one is in a position which is substantially horizontal and blocks the passage in the operating position of the turnstile. An unlockable blocking mechanism can be used to allow the blocking unit to rotate in response to a signal, this rotation being restricted such that the blocking arm which is initially in the blocking position moves out of this position and the following blocking arm assumes the blocking position, with the passage being temporarily opened for one person. It has been found in various turnstiles of this type that, on account of the comparatively fast rotation which said turnstiles must execute, a high impact force is produced and there is therefore a risk of injury, primarily to children who, on account of their small body size, may be struck in the upper region of the body or even the head by the following rotating blocking arm. In addition, this type of blocking unit takes up a relatively large amount of space.

Blocking barriers or barrier bars which can be pivoted horizontally or vertically through 90° are known primarily in gates for motor vehicles, but, when of correspondingly smaller design, have also previously been used for pedestrian gates. The impact force in the respective end position of the barrier also constitutes a problem in barriers of this type, all the more so when quick release and, subsequently, similarly quick renewed blocking of the path is required; in this case, it is necessary to provide measures for damping movement at the end of each pivoting movement, in order to prevent damage. The risk of injury is not precluded here either. In addition, a correspondingly large amount of space is likewise required on account of the pivoting movement of the barrier bar through 90°.

FR 2 849 519 and www.automaticsystems.com disclose a gate in which a circle-sector-like blocking element is pivoted out of a housing, which restricts the passage on one side, in response to a signal and thus blocks the passage. This blocking element is articulated approximately halfway up the housing. The result of this is that, whereas the upper region of passage can be blocked relatively well, a large gap through which the gate can be easily bypassed from below remains open in the lower region. Restrictions are placed on the size of this blocking element on account of the desired compact construction and even more so on account of the required stability.

www.automaticsystems.com likewise discloses a gate whose blocking element comprises two circle-sector-like blocking vanes which can slide one into the other in a telescopic manner and together into a lateral housing in order to open the passage. To this end, one, outer blocking vane is formed from two walls with a cavity in which said blocking vane can accommodate the other, inner blocking vane. The outer blocking vane can be pivoted about a pivot axis close to the floor; the inner blocking vane can be pivoted about a higher pivot axis. Although the passage is already blocked more effectively than in the case of the gate according to FR 2 849 519 as a result, the higher pivot axis of the inner blocking vane means that a gap which can be bypassed from below still remains open. The two blocking vanes have a guide groove which follows the sector arc and with which the outer blocking vane can be guided into the housing and the inner blocking vane can be guided into the outer blocking vane during their pivoting movement. In the process, the blocking vanes are subjected to continuous abrasive wear in these guide grooves and traces of this abrasive wear can already be seen from the outside after an extremely short period of operation.

Gunnebo Entrance Control AB discloses a gate with two blocking vanes which can slide one into the other in a telescopic manner. One, outer blocking vane is driven about a deeper-lying pivot axis to its pivot position by an electric motor via a lever mechanism. An upright metal plate which has a tooth system at its free end is provided in the housing. A semicircular gear wheel which is connected to the outer blocking vane and is mounted on the higher drive shaft of the other, inner blocking vane engages with this tooth system. When the outer blocking vane is pivoted about its pivot axis in a manner driven by the motor, the gear wheel rolls on the tooth system of the stationary metal plate and in the process carries along the inner blocking vane, so that said inner blocking vane is moved out of the outer blocking vane. The gear mechanism is very complicated and therefore relatively expensive, and at the same time susceptible to faults and not functionally reliable. It is subject to continuous abrasive wear and produces disturbing noise, particularly when, for cost reasons, a relatively crude tooth system is selected.

The object of the invention is to provide a blocking element of the type mentioned in the introduction which permits a space-saving and also lightweight construction, with which the passage can be blocked as far as possible over the full height of the gate housing, that is to say unauthorized passage through the gate is precluded, and with which the danger of injury can be largely avoided. In spite of the desired lightweight, compact construction, the required stability must be ensured in every case. The drive should be as simple and cost-effective as possible in terms of design, be subject to little wear and run smoothly.

(g) BRIEF SUMMARY OF THE INVENTION.

1. Purposes of the Invention

According to the invention, this is achieved in that the two blocking vanes are mounted close to the floor such that they can pivot about a common pivot axis and their radius corresponds approximately to the height of the support and of the housing, and in that the two blocking vanes can be driven by the drive motor in a manner controlled only by means of a lever system. Driving only by means of a lever system is very functionally reliable and not highly susceptible to faults, and at the same time relatively simple and inexpensive in terms of design and production. Since the blocking vanes are articulated close to the floor and their radius corresponds virtually to the height of the housing, the gate can be covered and blocked over almost its entire height by said blocking vanes.

2. Brief Description of the Invention

The lever system comprises a drive lever and transmission levers. The drive lever has three connection points which are situated at the corners of an imaginary, irregular triangle; the drive lever is firmly connected to the output shaft of the drive motor at the first connection point, a first transmission lever is articulated at the second connection point of said drive lever by way of one of its ends, said first transmission lever being connected in an articulated manner to one of the blocking vanes by way of its other end, and a second transmission lever is articulated at the third connection point of said drive lever by way of one of its ends, said second transmission lever being connected in an articulated manner to the other blocking vane by way of its other end.

When, according to a preferred embodiment, one, outer blocking vane comprises, in a manner which is known per se, two circle-sector-like side walls which are connected to one another by a curved outer wall, which corresponds to the circle sector, and thus form a cavity into which the other, inner blocking vane can be drawn in a telescopic manner, two transmission levers can then be connected in an articulated, spaced apart and parallel manner by way of one of their ends to the second connection point of the drive lever, said transmission levers in each case being articulated on one of the side walls of one, outer blocking vane by way of their other ends; the transmission lever which is connected to the inner blocking vane, which can be drawn into the outer blocking vane, is articulated at that connection point of the drive lever which is further away from the output shaft of the drive motor. On account of this lever system, when the drive lever rotates in the clockwise or counterclockwise direction in a manner driven by the drive motor, the blocking vanes are forcibly controlled and always cover a defined angle during their pivoting movement created in the process.

The transmission levers assume an extended position in relation to the drive lever in the blocking position of the blocking vanes, that is to say in the state in which they are drawn apart from one another, and the transmission levers are folded back onto the drive lever in the open position of the blocking vanes.

The drive motor and the lever system are preferably arranged approximately halfway up the support and the blocking vanes, and eyes for articulated connection to the transmission levers can be provided on the blocking vanes. As a result, the arrangement is provided with additional stability overall. The drive motor is preferably a brushless DC motor in the form of a direct drive. Short run times of the blocking vanes and low-noise operation can be achieved with this direct drive.

The blocking vanes can be guided on guide rails at their outer faces, which are in the form of an arc of a circle, during their pivoting movement. The guide rails provide the arrangement with additional stability, so that it is possible to form the blocking vanes such that they can cover and block the gate over virtually its entire height and therefore preclude the gate being bypassed from below.

Guide strips, which project beyond the outer wall of the outer blocking vane, are preferably provided on the side walls of said outer blocking vane, by means of which guide strips the outer blocking vane can slide along guide rails, which are formed in the manner of an arc of a circle and are arranged on the support, and accordingly a guide strip which projects beyond the outer wall of the inner blocking vane is provided on the inner blocking vane which can be drawn into the outer blocking vane, by means of which guide strip said inner blocking vane can slide along a guide rail which is formed in the manner of an arc of a circle and is arranged on the inner face of the outer wall of the outer blocking vane. As a result, there is a spacing between the outer faces of the blocking vanes and the guide rails, and contact between the outer faces and the guide rails is thus precluded, so that no friction, no frictional noise, no abrasive wear and no traces of abrasive wear can be produced.

In a further, advantageous refinement, a guide rail, which is formed in the manner of an arc of a circle, is fixed to the support and has on its outer and/or inner curved surface a groove. On the outer blocking vane, a roller or a ball bearing is arranged, between the vane outer wall and the support, on a shaft and engages in the groove in the guide rail; a further guide rail, which is in the form of an arc of a circle, is arranged on the circle-sector-like inner side of the outer blocking vane and likewise has a groove in which a roller or a ball bearing engages, which roller or ball bearing is arranged in the rear, upper region of the inner blocking vane. The outer blocking vane is laterally guided and supported by means of this type of guide too. Abrasive wear and traces of abrasive wear on the blocking vane are avoided.

A projection can be provided on the drive lever, which projection can rest against a stop, which is provided on the support, in the blocking position of the blocking vanes. Movement of the drive lever can thus be restricted, particularly in the case of a functional fault, for example a power cut.

A return spring is advantageously tensioned between the projection of the drive lever and the support, said return spring pivoting the drive lever in the event of a functional fault, for example a power cut, such that the blocking vanes are moved to their position which opens the passage and held there, so that it is possible to pass through the gate without obstruction; this is important particularly in an emergency situation.

In addition, a stop for the blocking vanes can be arranged on the support in the position of said blocking vanes which opens the passage. This stop also preferably serves for restricting movement in the event of a functional fault.

The blocking vanes are preferably of sandwich construction. They may comprise a very lightweight, but stable, foam insert or honeycomb structure which is coated or provided by adhesive bonding on both sides with a thin and lightweight metal plate or plastic plate, it being possible for the entire unit to be further covered with a soft PUR foam. This contributes to lightweight construction which, as already mentioned, permits very short run times of the blocking vanes of approximately 0.2 seconds. The PUR foam covering protects the inner part of the blocking vanes and contributes to personal protection on account of its softness.

In the case of a turnstile which has only one blocking vane as the blocking element, a corresponding guide can be provided for this blocking vane by a guide rail, which is in the form of an arc of a circle, being fixed to the support, said guide rail having on its outer and/or inner curved surface a groove in which a roller or a ball bearing engages, which roller or ball bearing is fixed to the blocking vane by means of a shaft.

To this end, a convexity can be integrally formed on one narrow side of the blocking vane, the shaft on which the roller or the ball bearing is arranged passing through said convexity.

The shaft with the roller or the ball bearing can alternatively be provided on the outer wall of the blocking vane.

The invention will be explained by way of example in greater detail below with reference to the attached drawing, in which:

(h) BRIEF DESCRIPTION OF THE SEVERAL VIEWS OF THE DRAWING(S).

Figure 2:
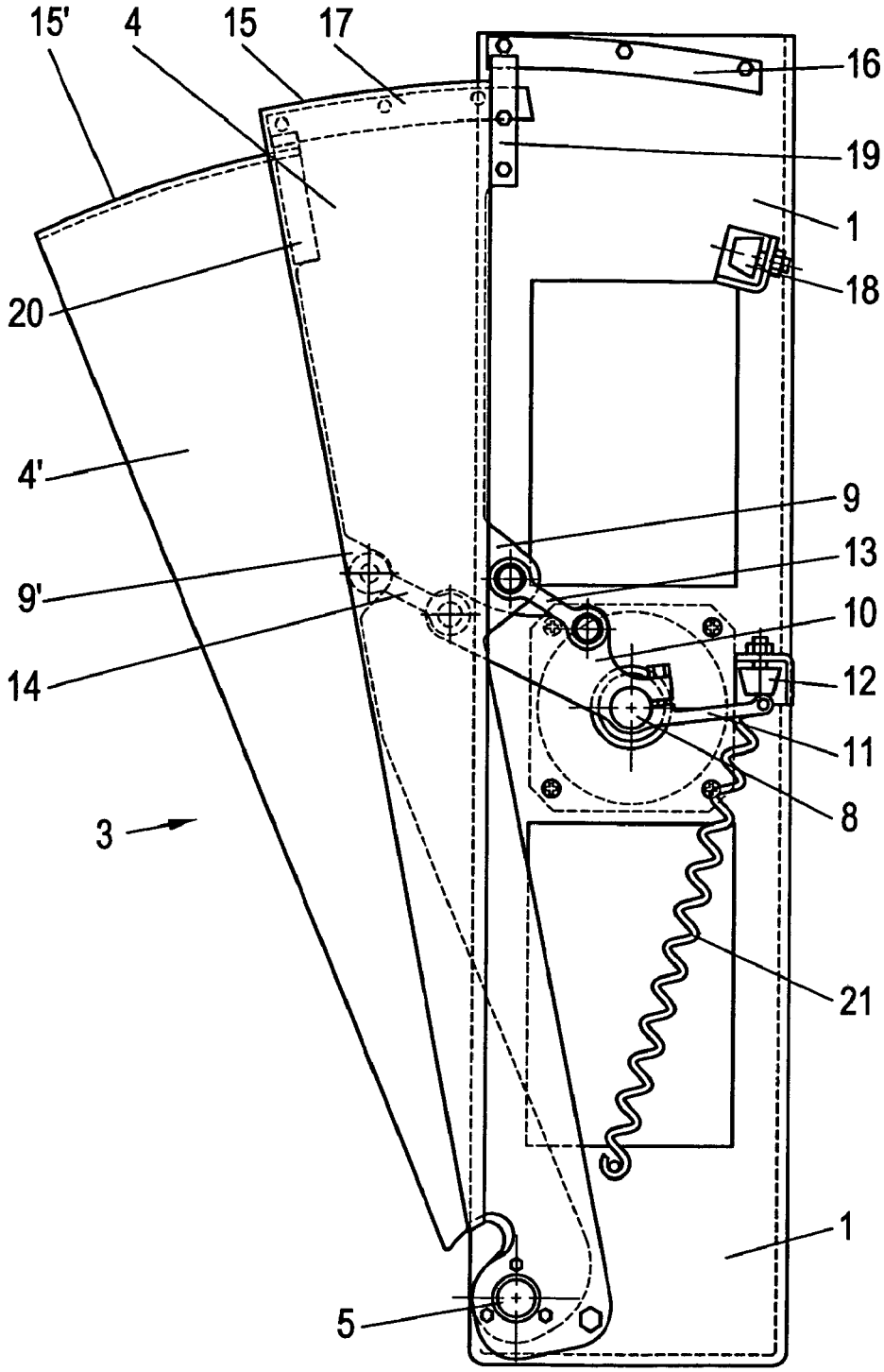
Figure 3:
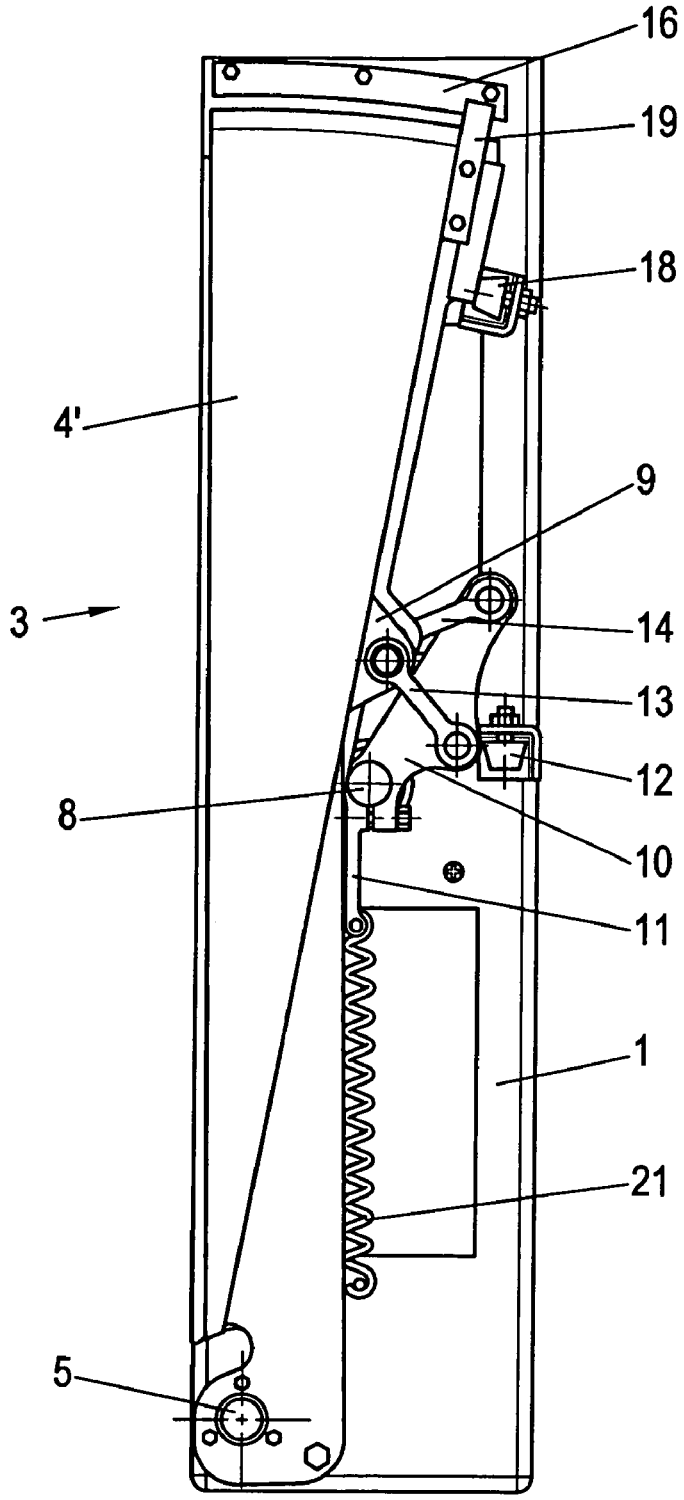
Figure 4:
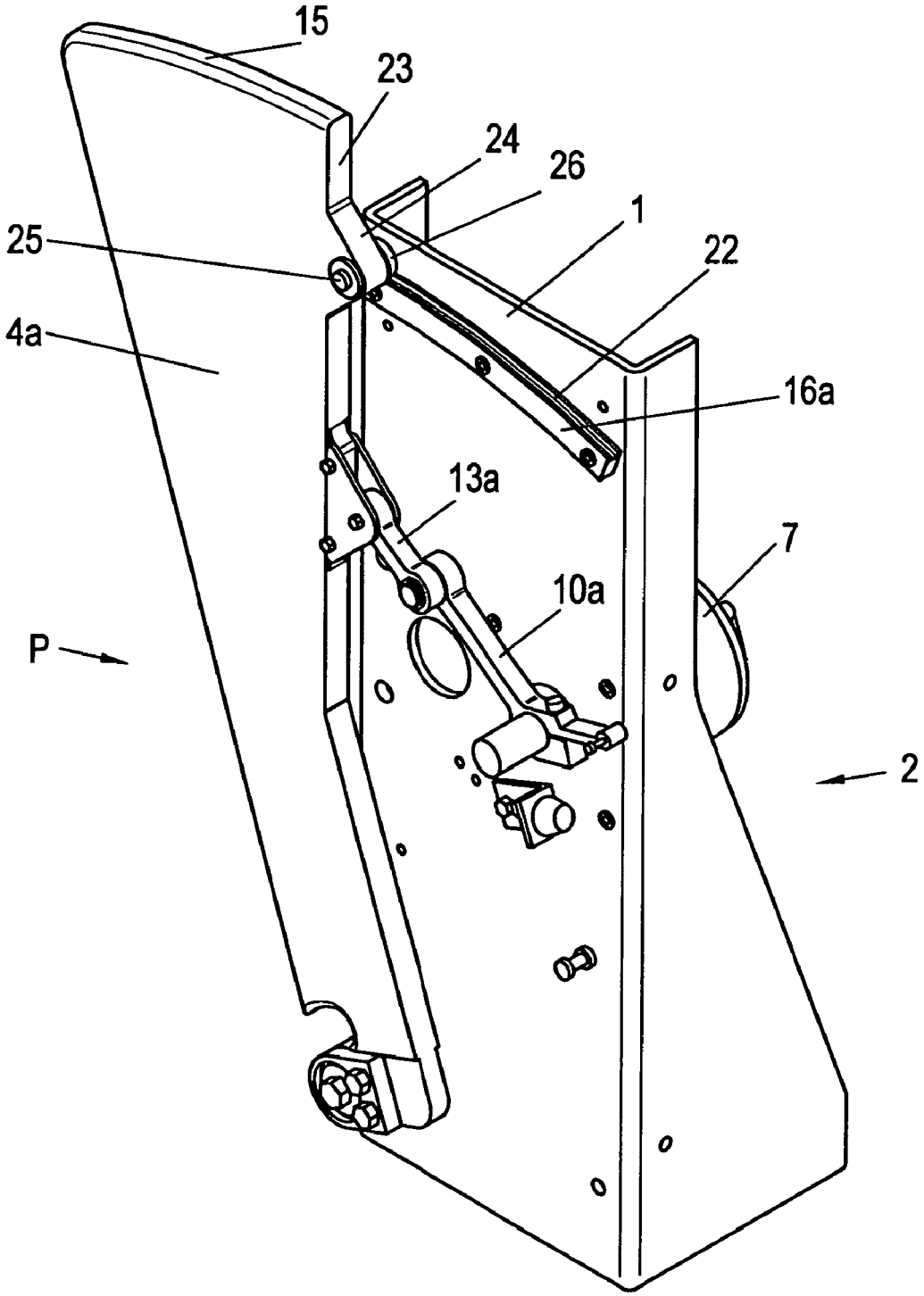
Figure 5:
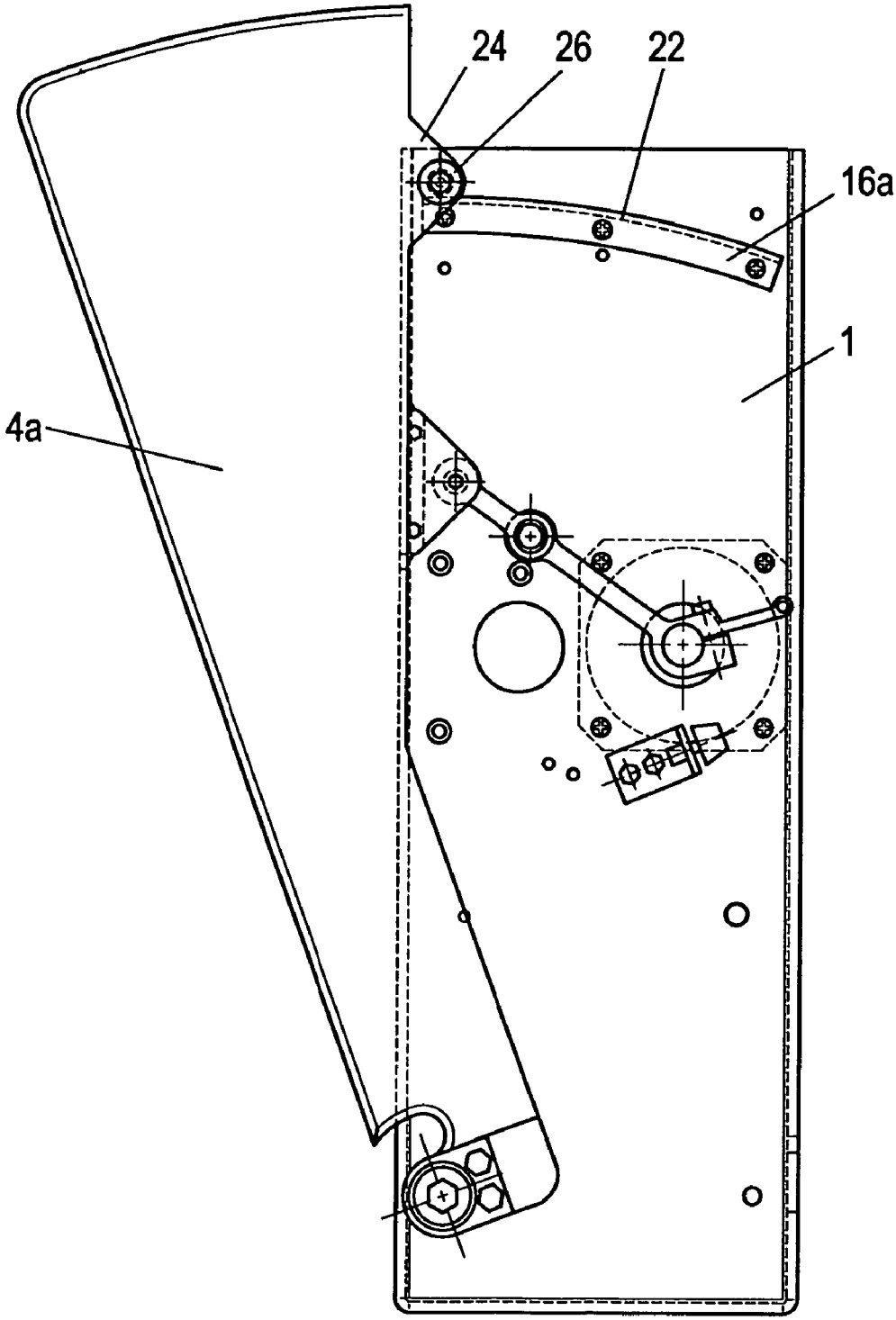
Figure 5A:
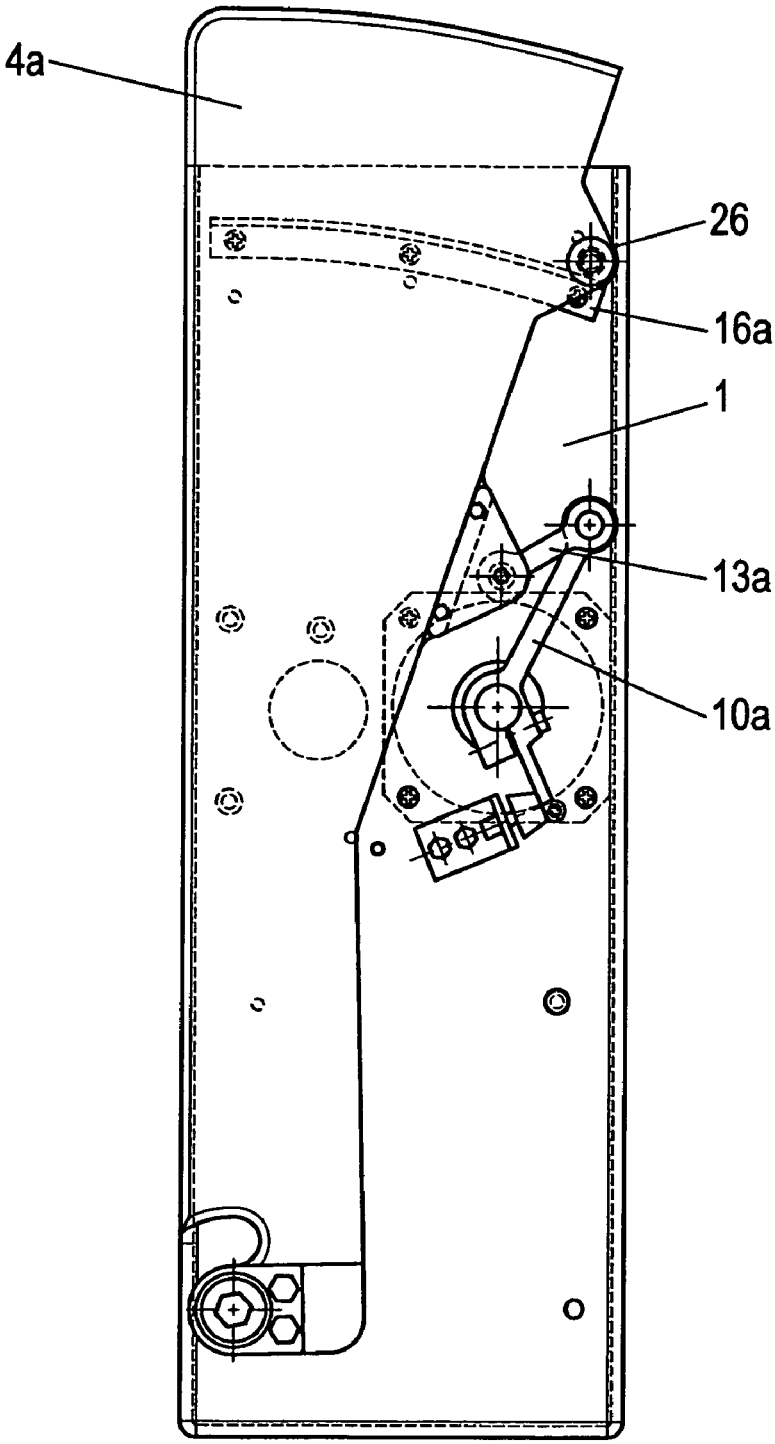
Figure 7:
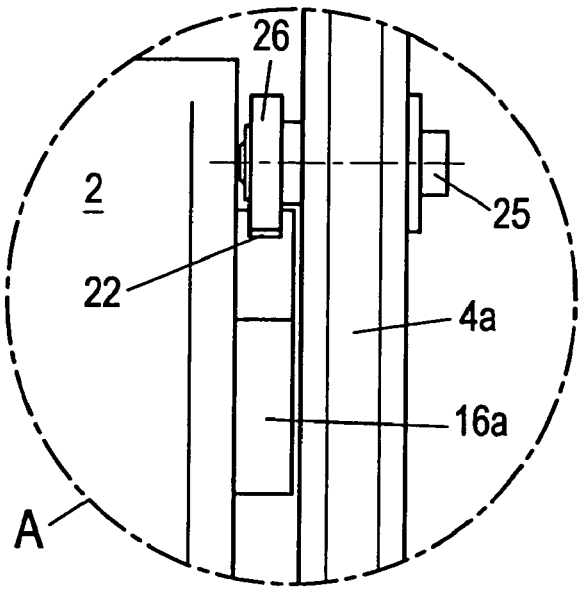
Figure 6:
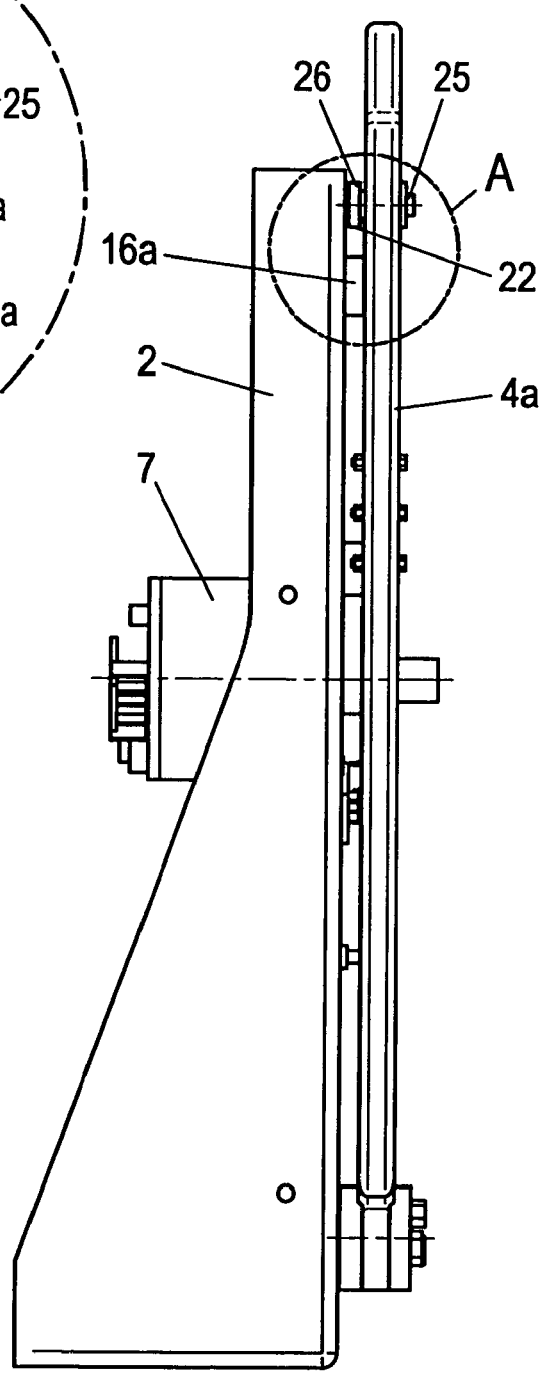

FIG. 1 shows a perspective view of a preferred embodiment of the blocking element in its starting position which blocks the passage, FIG. 2 shows the front view of the blocking element according to FIG. 1 in its starting position which blocks the passage, FIG. 3 shows the front view according to FIG. 2 in the position of the blocking element which opens the passage, FIG. 4 shows a perspective view of an embodiment of the guide of the blocking element, FIG. 5 shows the frontal view of the guide according to FIG. 4, FIG. 6 shows the side view of the guide in the direction of arrow P in FIG. 4, and FIG. 7 shows a detail A from FIG. 6.

(i) DETAILED DESCRIPTION OF THE INVENTION.

The blocking element 3 is mounted on the support wall 1 of an elongate, vertical support 2 which has a cross-section which is bent in the form of a U and is installed in a housing (not illustrated) of a pedestrian gate and whose height corresponds virtually to that of this housing. Said blocking element comprises two blocking vanes 4, 4' in the form of circle sectors which can slide one over the other or one into the other in a fan-like or telescopic manner in order to open the passage (see FIG. 3) and are moved apart in a reverse manner in order to block the passage (FIGS. 1 and 2). On their tapering sector inner side, the blocking vanes 4, 4' are mounted close to the floor of the housing on the support wall 1 such that they can pivot about a common pivot axis 5. The two blocking vanes 4, 4' are of sandwich construction. A very lightweight, but nevertheless stable, foam insert, for example comprising metal foam or foam made of another suitable material, or a honeycomb structure made of a suitable material is coated on both sides with a thin and light metal layer, for example of aluminum, or a plastic layer, for example of carbon fibers, or is provided by adhesive bonding with such a metal or plastic plate. These outer layers or plates are fitted with the bearing points for the pivot axis 5 and for a lever system which is described further below and serves to control the movement of the blocking vanes 4, 4'. On the outside, each blocking vane 4, 4' is further covered with a soft PUR foam which protects the inner parts and also contributes to personal protection on account of its softness. One, outer blocking vane 4 has two sector-like side walls 6 which are connected to the sector broad side by an outer wall 15, so that this outer blocking vane 4 includes a cavity into which the other, inner blocking vane 4' can slide in a telescopic or fan-like manner. The sector angle of the two blocking vanes 4, 4' is preferably identical, so that the outer blocking vane 4 exactly covers the inner blocking vane 4' in the state in which they are folded together.

A drive motor 7 whose output shaft 8 protrudes through an opening in the support wall 1 to the side of the blocking vanes 4, 4' is mounted approximately halfway up the support 2 on the inner side, which is averted from the blocking vanes 4, 4', of the support wall 1. The drive motor 7 is preferably a brushless DC motor in the form of a direct drive, that is to say without a gear mechanism. The motor 7 drives the blocking vanes 4, 4' by means of a lever system which is firmly connected to the output shaft 8 at one end and at the other end is connected in an articulated manner to the blocking vanes 4, 4' by means of eyes 9, 9' which are provided for this purpose approximately halfway up said blocking vanes. The drive lever 10 of this lever system has three connection points which define an imaginary, scalene triangle between them. At one connection point, the drive lever 10 is connected, for example firmly clamped, to the output shaft 8 of the drive motor 7, as illustrated in FIG. 1. At this point, an extension projection 11 protrudes from the drive lever 10, by means of which projection said drive lever can stop against a stop 12 which is provided on the support 2 (see FIGS. 1 and 2) during rotation of said drive lever for blocking movement of the blocking vanes 4, 4' as required (see below). The drive lever 10 has, opposite said projection 11 and at a distance from the first connection point, a second connection point at which two first transmission levers 13 are articulated parallel to one another by way of one of their ends and at a distance such that their respectively other end can be articulated by the respective eye 9 on one of the side walls 6 of the outer blocking vane 4 and the two transmission levers 13 thus jointly act on the outer blocking vane 4 in the same sense as a single transmission lever 13. A further, third connection point is provided on the drive lever 10, is further away from the first connection point than the second connection point and is also offset at an angle in relation to said second connection point. A second transmission lever 14 is articulated at this third connection point by way of one of its ends, while its other end is connected in an articulated manner to the eye 9' of the inner blocking vane 4' (see FIGS. 2 and 3). During their pivoting movement, the blocking vanes 4, 4' can be guided at the outer faces of their outer walls 15, 15', which run in the form of an arc of a circle, on guide rails 16, 17. To this end, two parallel guide rails 16, which are curved in the form of an arc of a circle in accordance with the outer wall 15 of the outer blocking vane 4, are arranged on the support wall 1 such that they are spaced apart over virtually their entire height; the outer blocking vane 4 can slide along said guide rails by way of the outer face of its outer wall 15 during the pivoting movement of said blocking vane. A guide rail 17 which is in the form of an arc of circle is arranged on the inner face of the outer wall 15 of the outer blocking vane 4 for the inner blocking vane 4', it accordingly being possible for the inner blocking vane 4' to slide along said guide rail into and out of the outer blocking vane 4 by way of the outer face of its outer wall 15' during the pivoting movement of said blocking vane.

According to a preferred embodiment, guide strips 19 which project beyond the outer wall 15 of the outer blocking vane 4 and by way of which said outer blocking vane can slide along the guide rails 16 are provided on the side walls 6 of the outer blocking vane 4 in order to prevent abrasive wear and visible traces of abrasive wear on the outer walls 15, 15' of the blocking vanes 4, 4'. A guide strip 20 which projects beyond the outer wall 15' on the inner blocking vane 4' and in turn can slide along the guide rail 17 in the outer blocking vane 4 is accordingly fitted to the inner blocking vane 4'. A spacing thus remains between the respective outer wall 15, 15' and the guide rails 16, 17 in question (see FIG. 2), so that the outer walls 15, 15' cannot come into contact with the guide rails 16, 17 and abrasive wear is avoided.

The guide rails 16, 17 and guide strips 19, 20 provide the arrangement with stability which permits the blocking vanes 4, 4' to be dimensioned, as illustrated, such that they both extend almost over the entire height of the gate or its housing and thus can cover, that is to say block, the delimited passage region over virtually the entire height.

In the event of a functional fault, for example a power cut, it is necessary to ensure that the passage then remains open and can be passed through without obstruction. To this end, a return spring 21 is tensioned between the projection 11 of the drive lever 10 and a suitable point on the support 2, said return spring moving the blocking vanes 4, 4' to the position according to FIG. 3, which opens the passage, by means of the drive lever 10 and holding them in this position in such a case. A further stop 18, against which the blocking vanes 4, 4' stop in this case, is also provided in the upper region, for example in the upper quarter, of the support wall 1. The abovementioned stop 12 for the projection 11 is also provided primarily for restricting movement in the event of a functional fault. However, it can also be used as a stop during normal operation when, for example, the drive motor 7 used is not a brushless DC motor as described above but instead an unregulated drive, for example a torque motor.

FIGS. 1 and 2 show the blocking element in its starting position which blocks the passage. The two blocking vanes 4, 4' are pivoted out into the passage region of the gate about their common pivot axis 5 and are positioned at an angle to the support 2 and accordingly also to the housing (not illustrated) of the gate. The inner blocking vane 4' is pivoted out of the outer blocking vane 4 in a telescopic manner; its angle in relation to the support 2 is twice that of the outer blocking vane 4 if the two blocking vanes 4, 4' have the same sector angle, as is illustrated. The drive lever 10 is rotated in the counterclockwise direction, that is to say in the pivoting direction of the blocking vanes 4, 4', its projection 11 can rest against the stop 12, the return spring 21 is tensioned. As can be seen more clearly in the schematic illustration of FIG. 2, the transmission levers 13 and 14 are in a position which is extended in relation to the drive lever 10 and lengthens it. In response to a signal to the drive motor 7 to open the passage, said drive motor rotates the drive lever 10 in the clockwise direction by means of its output shaft 8, with said drive lever carrying along the transmission levers 13 and 14 in such a way that they fold back onto the drive lever 10 in their articulated connection (see FIG. 3) and for their part carry along the two blocking vanes 4, 4' in a manner acting on the eyes 9, 9', so that said blocking vanes pivot out of the passage region of the gate in the clockwise direction about their common pivot axis 5 and the inner blocking vane 4' is drawn into the cavity in the outer blocking vane 4, with the blocking vanes 4, 4' sliding along their respective guide rails 16, 17 by way of their guide strips 19, 20. In their end position which opens the passage, the two blocking vanes 4, 4' are situated vertically in front of the support 2, the outer blocking vane 4 can rest against the stop 18, and the inner blocking vane 4' is drawn fully into the outer blocking vane 4. In order to block the passage once again, the drive lever 10 is rotated in the counterclockwise direction, and the lever system 10, 13, 14 folds up again and allows the two blocking vanes 4, 4' to slide into their blocking position according to FIGS. 1 and 2.

Since the blocking element, as is known per se, comprises two or even more blocking vanes 4, 4' which can slide one into the other in a telescopic manner, the gate can be constructed in a space-saving manner, for example the housing can be correspondingly narrower than in the case of other known gates. The movement of the blocking vanes 4, 4', their pivoting angle, is guided in a forcibly controlled manner by the lever system 10, 13, 14, so that hard impacts in the end positions are avoided and, as a result, the risk of injury to users is considerably reduced too. The lever system 10, 13, 14 which is arranged approximately halfway up the gate and the guide rails 16, 17, which are provided over virtually the entire height, for the blocking vanes 4, 4' provide the arrangement with a high degree of stability which permits the blocking vanes 4, 4', even with the described lightweight construction, to be dimensioned such that they extend virtually over the entire height of the gate and can cover almost the entire height of the passage region. Bypassing the gate from below is therefore virtually precluded. The lever system 10, 13, 14 is comparatively simple in terms of design and manner of operation, but at the same time highly functionally reliable and not susceptible to faults. It can be configured to run very smoothly and therefore does not create any disturbing noise either.

On account of the lightweight but stable construction of the blocking vanes 4, 4' together with the abovementioned direct drive, very short run times (approximately 0.2 seconds) of the blocking element or of the blocking vanes 4, 4' can be achieved, and said blocking element or blocking vanes nevertheless move with very little noise and are very stable with respect to lateral forces. The arrangement has a very low moment of inertia.

FIG. 4 shows another advantageous embodiment of the guide of the blocking element on the support 2, in this case using the example of a blocking element with only one circle-sector-like blocking vane 4*a*. A guide rail 16*a*, which is formed in the manner of an arc of a circle and has a groove 22 on its outer or inner curved surface, is fixed to the support wall 1. A convexity 24 is provided on one narrow side 23 of the blocking vane 4*a*, a shaft 25, on which a roller 26 or a ball bearing 26 which can engage and roll in the groove 22 in the guide rail 16*a* is arranged, passing through said convexity. The blocking vane 4*a* is also laterally guided and supported by this guide. The single blocking vane 4*a* is likewise driven by a drive motor 7 by means of a lever system comprising the drive lever 10*a* and the transmission lever 13*a*, with the drive lever 10*a* requiring only two connection points in this case since only one blocking vane 4*a* has to be moved, one connection point for connection to the output shaft 8 of the drive motor and one connection point for connection to the transmission lever 13*a*.

If this type of guide is transferred to a blocking element 3 with two blocking vanes 4, 4' according to FIGS. 1 to 3, the shaft 25 with the roller 26 or the ball bearing 26 is then expediently arranged between the outer wall 15 of the outer blocking vane 4 and the support wall 1 such that it is likewise possible to engage and roll in the groove 22 in a guide rail 16*a*. A further guide rail, which is in the form of an arc of a circle and has a groove in its bent inner face, is then accordingly arranged on the inner side of, that is to say within, the outer blocking vane 4. The inner blocking vane 4' accordingly has a roller or a ball bearing, which engages in the groove in this guide rail, in the rear, upper region. Therefore, the inner blocking vane 4' is guided on the outer blocking vane 4 and the outer blocking vane 4 is guided on the support wall 1 such that the outer wall 15' of the inner blocking vane 4' cannot come into contact with the guide rail in the outer blocking vane 4' or its inner wall, and that the outer face 15 of the outer blocking vane 4 cannot come into contact with the guide rail 16*a* either, and abrasive wear is avoided. This type of guide also contributes, as described, to stability of the entire apparatus.

LIST OF REFERENCE SYMBOLS

1 Support wall
2 Support
3 Blocking element
4, 4', 4*a* Blocking vane
5 Pivot axis
6 Side walls
7 Drive motor
8 Output shaft
9, 9' Eyes
10, 10*a* Drive lever
11 Projection
12 Stop
13, 13*a* First transmission lever
14 Second transmission lever
15, 15' Outer wall
16, 16*a* Guide rails of the outer blocking vane
17 Guide rail of the inner blocking vane
18 Stop
19 Guide strip of the outer blocking vane
20 Guide strip of the inner blocking vane
21 Return spring
22 Groove
23 Narrow side
24 Convexity
25 Shaft
26 Roller/ball bearing

The invention claimed is:

1. A blocking element for a gate used as a checkpoint, which comprises two blocking vanes each of which are in a form of a circle sector and are mounted, by way of a tapering sector inner side of the blocking vanes and such that the blocking vanes can pivot about a horizontally directed pivot axis, on a support which is arranged in a housing and in response to a signal, in a manner driven by a drive motor, can slide one into the other in a telescopic manner from a position which blocks a passage of the gate, in order to open the passage of the gate, and can be drawn apart from one another in order to again block the passage of the gate, characterized in that the two blocking vanes (4, 4') are mounted close to a floor of the gate such that the blocking vanes (4, 4') can pivot about the common horizontally directed pivot axis (5) and a radius of the blocking vanes (4,4') corresponds approximately to a height of the support (2) and a height of the housing, and in that the two blocking vanes (4, 4') can be driven by the drive motor (7) in a manner controlled only by means of a lever system (10, 13, 14).

2. The blocking element as claimed in claim 1, characterized in that the lever system comprises a drive lever (10) and transmission levers (13, 14), in that the drive lever (10) has three connection points which are situated at corners of an imaginary, irregular triangle, in that the drive lever (10) is firmly connected to an output shaft (8) of the drive motor (7) at a first connection point, in that a first transmission lever (13) is articulated at a second connection point of said first transmission lever by way of one of ends of the drive lever, said first transmission lever being connected in an articulated manner to one of the blocking vanes (4) by way of another end of the first transmission lever (13), and in that a second transmission lever (14) is articulated at a third connection point of said drive lever by way of one of ends of the second transmission lever (14), said second transmission lever being connected in an articulated manner to another blocking vane (4') by way of another end of the second transmission lever (14).

3. The blocking element as claimed in claim 2, characterized in that one outer blocking vane (4) comprises, in a manner which is known per se, two side walls (6) which are formed as a circle sector and are connected to one another by a curved outer wall (15), which curved outer wall corresponds to a circle sector, and a cavity is thus formed, into which cavity another inner blocking vane (4') can be drawn in a telescopic manner, in that furthermore two transmission levers (13) are connected in an articulated, spaced apart and parallel manner by way of one of the ends of the transmission levers (13) to the second connection point of the drive lever (10), said transmission levers in each case being articulated on one of the side walls (6) of one, outer blocking vane (4) by way of other ends of said transmission levers (13), and in that the transmission lever (14) which is connected to an inner blocking vane (4'), which can be drawn into the outer blocking vane (4), is articulated at a connection point of the drive lever (10) which is further away from the output shaft (8) of the drive motor (7).

4. The blocking element as claimed in claim 3, characterized in that guide strips (19), which project beyond the outer wall (15) of the outer blocking vane (4), are provided on the side walls (6) of said outer blocking vane (4), by means of which guide strips (19) the outer blocking vane (4) can slide along guide rails (16), which are formed in the manner of an arc of a circle and are arranged on the support (2), and in that a guide strip (20), which projects beyond the outer wall (15') of the inner blocking vane (4'), is provided on the inner blocking vane (4') which can be drawn into the outer blocking vane (4), by means of which guide strip said inner blocking vane (4') can slide along a guide rail (17) which is in a form of an arc of a circle and is arranged on the inner face of the outer wall (15) of the outer blocking vane (4).

5. The blocking element as claimed in claim 3, characterized in that a guide rail (16*a*), which is formed in a manner of an arc of a circle, is arranged on a wall (1) of the support (2) and wherein the guide rail (16*a*) has a curved surface with a groove (22), in which groove (22) a roller (26) or a ball bearing (26) engages, which roller or ball bearing is fixed to the outer wall (15) of the outer blocking vane (4) by means of a shaft (25), and in that a further guide rail, which further guide rail is in a form of an arc of a circle, is arranged on an inner side of the outer blocking vane (4) in a form of a circle sector and wherein the further guide rail likewise has a further groove in which a roller or a ball bearing engages, which further groove is arranged in the rear, upper region of an inner blocking vane (4').

6. The blocking element as claimed in claim 5, characterized in that a return spring (21) is tensioned between a projection (11) of the drive lever (10) and the support (2).

7. The blocking element as claimed in claim 2, characterized in that a projection (11) is provided on the drive lever (10), which projection can rest against a stop (12), which is provided on the support (2), in a blocking position of the blocking vanes (4, 4').

8. The blocking element as claimed in claim 2, characterized in that the transmission levers (13, 14) assume an extended position in relation to the drive lever (10) in the blocking position of the blocking vanes (4, 4') and the transmission levers (13, 14) are folded back onto the drive lever (10) in an open position of the blocking vanes (4,4').

9. The blocking element as claimed in claim 2, characterized in that the drive motor (7) and the lever system (10, 13, 14) are arranged approximately halfway up the support (2), which is arranged in the housing of the gate, and halfway up the blocking vanes (4, 4'), and eyes (9, 9') for an articulated connection to the transmission levers (13, 14) are provided on the blocking vanes (4,4').

10. The blocking element as claimed in claim 1, characterized in that the drive motor (7) is a brushless DC motor in a form of a direct drive.

11. The blocking element as claimed in claim 1, characterized in that the blocking vanes (4, 4') are guided during a pivoting movement of the blocking vanes (4, 4') on guide rails (16, 17) at outer faces (15, 15') of the blocking vanes (4, 4'), wherein the outer faces (15, 15') are in a form of an arc of a circle.

12. The blocking element as claimed in claim 1, characterized in that a stop (18) for the blocking vanes (4, 4') is arranged on the support (2) in a position of said blocking vanes which opens the passage.

13. The blocking element as claimed in claim 1, characterized in that the blocking vanes (4, 4') are of sandwich construction.

14. The blocking element as claimed in claim 13, characterized in that both sides of a foam insert are coated with a thin metal plate and this unit is covered with a soft PUR foam.

15. A blocking element for a gate used as a checkpoint comprising a housing having a height;

a support having a second height and arranged in the housing;

a horizontally directed pivot axis furnished on the support;

a pair of blocking vanes each of which are in a form of a circle sector, wherein the pair of blocking vanes are mounted, by way of a tapering sector inner side of the blocking vanes and such that the blocking vanes can pivot about the horizontally directed pivot axis;

a drive motor connected to the blocking vanes on the pivot axis, wherein the drive motor in response to a signal, slides one of the blocking vanes into the other in a telescopic manner from a position which blocks a passage of the gate into a position, which opens the passage of the gate, and wherein the blocking vanes can be drawn apart from one another in order to again block the passage of the gate, wherein the pair of blocking vanes (4, 4') are mounted close to a floor of the gate such that the blocking vanes (4, 4') can pivot about a common horizontally disposed pivot axis (5) and a radius of the blocking vanes (4, 4') corresponds approximately to the second height of the support (2) and to the height of the housing, and wherein the pair of blocking vanes (4, 4') can be driven by the drive motor (7);

a lever system (10, 13, 14) connected to the drive motor for controlling the drive motor and therewith the blocking vanes.

16. The blocking element as claimed in claim 15, wherein the lever system comprises a drive lever (10) and transmission levers (13, 14), wherein the drive lever (10) has three connection points which are situated at corners of an imaginary, irregular triangle; and further comprising an output shaft furnished at the drive motor, wherein the drive lever (10) is firmly connected to the output shaft (8) of the drive motor (7) at a first connection point, wherein a first transmission lever (13) is articulated at a second connection point of said drive lever by way of one of ends of the drive lever, said first transmission lever being connected in an articulated manner to one of the blocking vanes (4) by way of another end of the first transmission lever (13), and in that a second transmission lever (14) is articulated at a third connection point of said drive lever by way of one of ends of the second transmission lever (14), said second transmission lever being connected in an articulated manner to another blocking vane (4') by way of another end of the second transmission lever (14).

17. A blocking element for a gate used as a checkpoint, which comprises two blocking vanes each of which are in a form of a circle sector and are mounted, by way of a tapering sector inner side of the blocking vanes and such that the blocking vanes can pivot about a horizontally directed pivot axis, on a support which is arranged in a housing and in response to a signal, in a manner driven by a drive motor, can slide one into the other as a fan from a position which blocks a passage of the gate, in order to open the passage of the gate, and can be drawn apart from one another in order to again block the passage of the gate, characterized in that the two blocking vanes (4, 4') are mounted close to a floor of the gate such that the blocking vanes (4, 4') can pivot about a common horizontally directed pivot axis (5) and a radius of the blocking vanes (4, 4') corresponds approximately to a height of the support (2) and a height of the housing, and in that the two blocking vanes (4, 4') can be driven by the drive motor (7) in a manner controlled only by means of a lever system (10, 13, 14).

18. The blocking element as claimed in claim 17, characterized in that the lever system comprises a drive lever (10) and transmission levers (13, 14), in that the drive lever (10) has three connection points which are situated at corners of an imaginary, irregular triangle, in that the drive lever (10) is firmly connected to an output shaft (8) of the drive motor (7) at a first connection point, in that a first transmission lever (13) is articulated at a second connection point of said first transmission lever by way of one of ends of the drive lever, said first transmission lever being connected in an articulated manner to one of the blocking vanes (4) by way of another end of the first transmission lever (13), and in that a second transmission lever (14) is articulated at a third connection point of said drive lever by way of one of ends of the second transmission lever (14), said second transmission lever being connected in an articulated manner to another blocking vane (4') by way of another end of the second transmission lever (14).

19. The blocking element as claimed in claim 18, characterized in that one outer blocking vane (4) comprises two side walls (6) which are formed as a circle sector and are connected to one another by a curved outer wall (15), which curved outer wall corresponds to a circle sector, and a cavity is thus formed, into which cavity another inner blocking vane (4') can be drawn in a telescopic manner, in that furthermore two transmission levers (13) are connected in an articulated, spaced apart and parallel manner by way of one of the ends of the transmission levers (13) to the second connection point of the drive lever (10), said transmission levers in each case being articulated on one of the side walls (6) of one, outer blocking vane (4) by way of other ends of said transmission levers (13), and in that the transmission lever (14) which is connected to an inner blocking vane (4'), which can be drawn into the outer blocking vane (4), is articulated at a connection point of the drive lever (10) which is further away from the output shaft (8) of the drive motor (7).

20. The blocking element as claimed in claim 18, characterized in that the transmission levers (13, 14) assume an extended position in relation to the drive lever (10) in the blocking position of the blocking vanes (4, 4'), and the transmission levers (13, 14) are folded back onto the drive lever (10) in an open position of the blocking vanes (4, 4').

* * * * *